US010046330B2

(12) United States Patent
Wada et al.

(10) Patent No.: US 10,046,330 B2
(45) Date of Patent: Aug. 14, 2018

(54) REGENERATED CUTTING BLADE AND SHEARING TYPE GRINDER

(75) Inventors: Naoya Wada, Miki (JP); Naoki Ueno, Miki (JP); Yasuhiko Honda, Miki (JP); Isao Nagai, Miki (JP)

(73) Assignee: Kabushiki Kaisha Kinki, Hyogo (JP)

( * ) Notice: Subject to any disclaimer, the term of this patent is extended or adjusted under 35 U.S.C. 154(b) by 441 days.

(21) Appl. No.: 14/417,344

(22) PCT Filed: Aug. 28, 2012

(86) PCT No.: PCT/JP2012/071643

§ 371 (c)(1),
(2), (4) Date: Apr. 8, 2015

(87) PCT Pub. No.: WO2014/033825

PCT Pub. Date: Mar. 6, 2014

(65) Prior Publication Data

US 2015/0251188 A1 Sep. 10, 2015

(51) Int. Cl.

| | |
|---|---|
| ***B02C 18/00*** | (2006.01) |
| ***B02C 18/18*** | (2006.01) |
| ***B02C 18/14*** | (2006.01) |

(52) U.S. Cl.

CPC ..... *B02C 18/184* (2013.01); *B02C 18/142* (2013.01); *B02C 18/145* (2013.01)

(58) Field of Classification Search

CPC .... B02C 18/184; B02C 18/145; B02C 18/142
See application file for complete search history.

(56) References Cited

U.S. PATENT DOCUMENTS 3,045,934 A * 7/1962 Eilers ..... B02C 13/28 241/197
6,131,838 A * 10/2000 Balvanz ..... B02C 13/2804 241/195
6,419,173 B2 * 7/2002 Balvanz ..... B02C 13/2804 241/195

(Continued)

FOREIGN PATENT DOCUMENTS

JP 8-323233 12/1996
JP 9-234384 9/1997

(Continued)

OTHER PUBLICATIONS

International Search Report (ISR) dated Oct. 30, 2012 in International (PCT) Application No. PCT/JP2012/071643.

*Primary Examiner* — Faye Francis
(74) *Attorney, Agent, or Firm* — Wenderoth, Lind & Ponack, L.L.P.

(57) ABSTRACT

A regenerated cutting blade to be mounted and used in a shearing type grinder. The cutting blade includes a fixed part and a blade tip projecting outward from this fixed part, in which the blade tip has a leading edge pointed toward the rotating direction. Side edges 110 on the lateral side outer periphery including the blade tip, the leading end edge and the side edges are regenerated and formed by build-up welding. The lateral sides are provided with slip preventive build-up welding parts 111, 112, 113 extending from the side edges 110 toward the central side of its rotation or the central direction, and the build-up welding parts are formed by three regenerating processes.

5 Claims, 13 Drawing Sheets

(56) References Cited

U.S. PATENT DOCUMENTS

| | | | | |
|---|---|---|---|---|
| 6,481,654 | B1 * | 11/2002 | Balvanz | B02C 13/2804 241/191 |
| 6,622,951 | B1 * | 9/2003 | Recker | B02C 13/2804 241/191 |
| 7,140,569 | B2 * | 11/2006 | Young | B02C 13/04 241/195 |
| 7,438,097 | B2 * | 10/2008 | Davis | B02C 13/2804 144/174 |
| 7,621,477 | B2 * | 11/2009 | Young | B02C 13/28 241/194 |
| 8,033,490 | B1 * | 10/2011 | Young | B02C 13/28 241/194 |

FOREIGN PATENT DOCUMENTS

| | | |
|---|---|---|
| JP | 2004-66226 | 3/2004 |
| JP | 2005-319545 | 11/2005 |
| JP | 2010-260000 | 11/2010 |
| JP | 2010-264353 | 11/2010 |
| JP | 2012-101142 | 5/2012 |
| JP | 2012-196610 | 10/2012 |

* cited by examiner

FIG. 11 - PRIOR ART

FIG. 12 - PRIOR ART
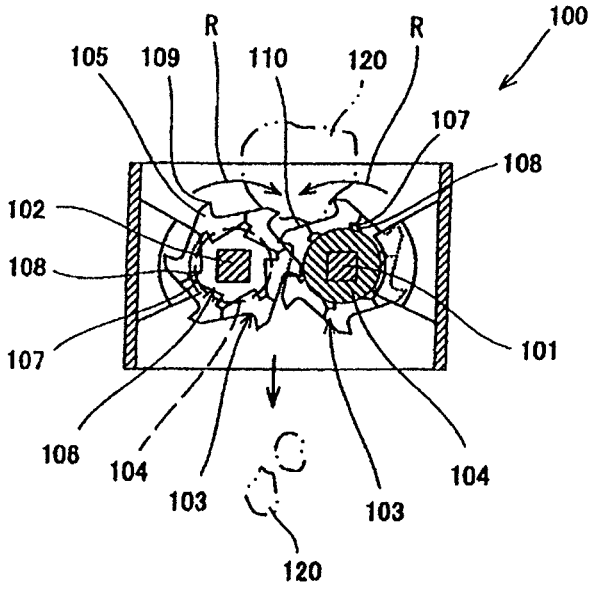

FIG. 13 - PROIR ART
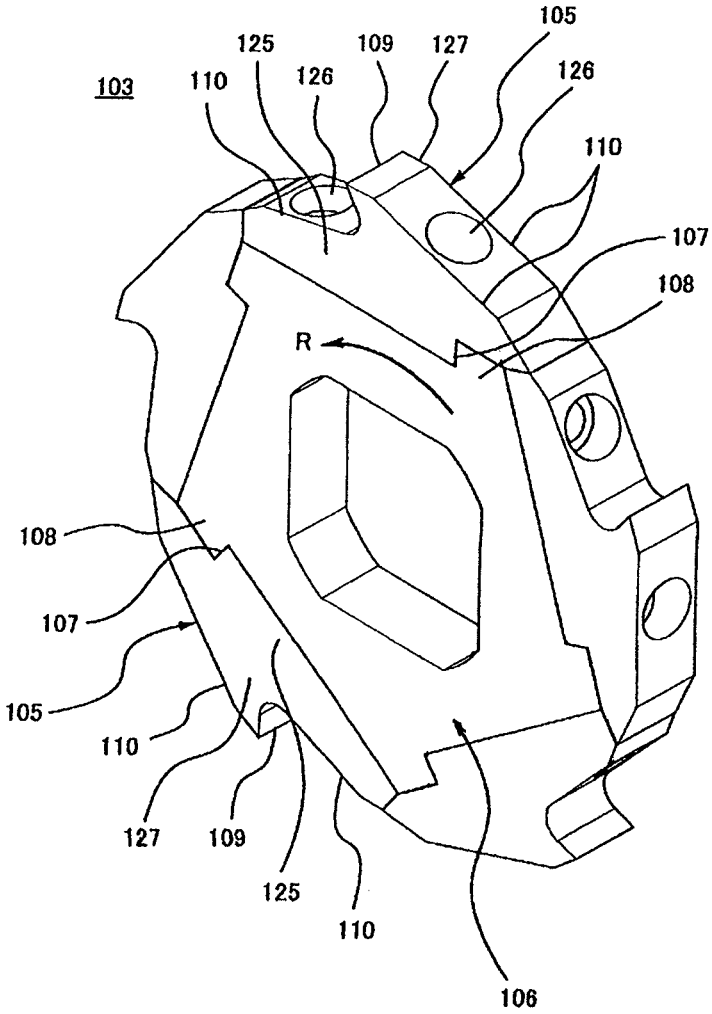

FIG. 14b - PRIOR ART
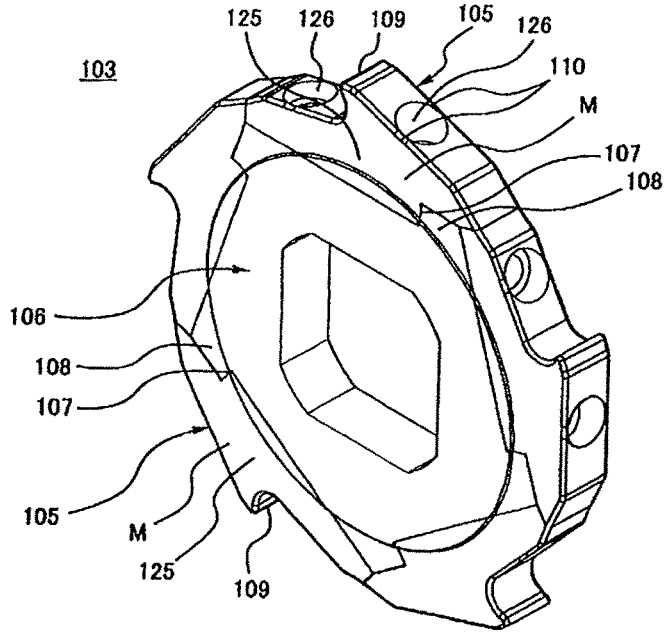
FIG. 14a - PRIOR ART
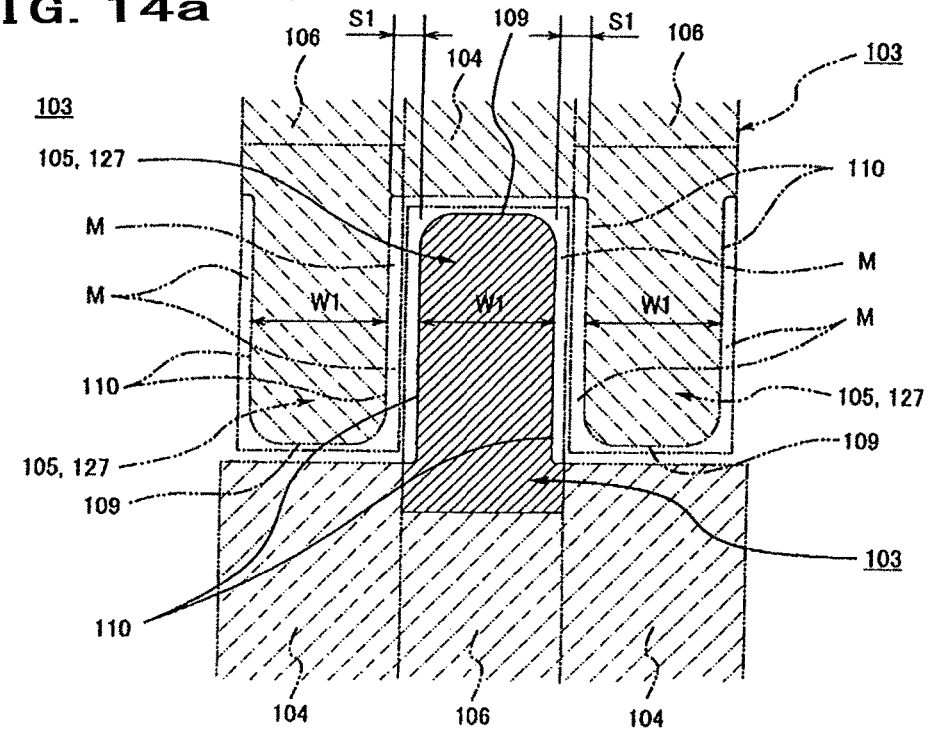

REGENERATED CUTTING BLADE AND SHEARING TYPE GRINDER

TECHNICAL FIELD

The present invention relates to a regenerated cutting blade used in a shearing type grinder, and a shearing type grinder.

BACKGROUND ART

Conventionally, a shearing type grinder for shearing and grinding plastic, wood, paper, metal, rubber, fiber, leather, or other solid objects has been known. For example, the shearing type grinder of this kind includes a shearing type grinder the present applicant filed previously (see Japanese Patent Laid-open Publication No. 8-323232).

As shown in a cross-sectional view of FIG. 11 illustrating a shearing type grinder, and in a C-C sectional view of FIG. 12, the conventional shearing type grinder 100 has a plurality of rotary blades 103 provided alternately across a spacer 104 in the axial direction of rotational axes 101, 102. The spacer 104 is formed in an outside diameter so that the base part of the rotary blades 103 may be positioned in the axial direction as shown in FIG. 11, so that the rotary blades 103 may be positioned in the axial direction and detachably mounted.

These rotary blades 103 are, as shown in FIG. 11, provided with a tool rest 106 detachably mounted on the rotational axes 101, 102, and a split type cutting blade 105 detachably mounted so as to surround the periphery of the tool rest 106. The rotary blades 103 are disposed in an overlapped state between mutually opposite sides of the rotary blades 103 rotating in the rotational direction R side, so that the mutual cutting blades 105 may be engaged with each other across a gap of, for example, 0.5 mm to 1 mm in the axial direction.

The cutting blades 105 provided on the outer circumference of the rotary blades 103 attract the workpiece to be ground 120, and grind the workpiece 120 by shearing actions between mutually opposite rotary blades 103.

Further, as shown in FIG. 13, an engagement step 107 is provided on the mounting surface of the cutting blades 105, and this engagement step 107 is engaged with an engagement protrusion 108 formed on the tool rest 106 so as to receive the grinding reaction. This split type cutting blade 105 includes a leading end edge 109 pointed in the rotational direction of a blade tip 127 projecting outward, and a side edge 110 (lateral edge) formed along the side outer periphery.

The leading end edge 109 and the side edge 110 are worn in an early stage due to shearing and grinding actions as shown in FIG. 14 (*a*), (*b*), but since the cutting blade 105 having the leading end edge 109 and the side edge 110 is formed in a split type, if the leading end edge 109 and the side edge 110 are worn out, only the cutting blade 105 can be replaced.

In the cutting blade 105 of the shearing type grinder 100 of this type, since the workpiece is attracted and ground by the leading end edge 109, and is sheared and ground by the leading end edge 109 and the side edge 110, the leading end edge 109 and the side edge 110 are worn early. The portion M shown in FIG. 14 (*a*), (*b*) is the worn portion.

An early wearing is a round wearing in the leading end edge 109 and the side edge 110, and this wearing causes the grinding performance to lower and the grinding efficiency to decline. Alternatively, depending on the workpiece, the leading end edge 109 and the side edge 110 may be cut off, and this defect may also cause the grinding performance and the grinding efficiency to lower.

Such wearing causes the grinding performance to lower and the grinding efficiency to decline because, as shown in FIG. 14 (*b*), the gap S1 between the side face and the side face of the mutually adjacent cutting blades 105 is extended to a double size of the worn portion M, and the workpiece drops in this widened gap S1, and passes through.

Therefore, if such wearing or defect (hereinafter called wearing loss) occurs, the cutting blade 105 is generally replaced with a new one.

However, even in the shearing type grinder 100 employing such split type cutting blade 105, for example, since scores of the cutting blades 105 are commonly used in one unit, it requires much cost and labor for replacement.

Moreover, the cutting blade 105 is manufactured of an expensive material entirely such as an alloy tool steel in order to enhance the wear resistance. In the case of the shearing type grinder 100 comprising many cutting blades 105 as mentioned above, an immense cost will be needed if attempting to replace the entire cutting blades 105 with new ones. It is also contrary to effective use of resources.

SUMMARY OF THE INVENTION

The invention has therefore been developed in order to solve the above problems. It is an object of the invention to be capable of regenerating the cutting blades efficiently while saving time and labor for replacement, and to present regenerated cutting blades enhanced in the grinding efficiency of the shearing type grinder close to that of new cutting blades when mounted and used in the shearing type grinder, and the shearing type grinder using such blades.

The regenerated cutting blade relating to the present invention comprises a fixed part, and a blade tip projecting from this fixed part outward in the radial direction. This blade tip has a leading end edge projecting toward the rotating direction, and has side edges provided at the lateral peripheral edges including the blade tip. The leading end edge and the side edges are regenerated and formed by build-up welding, and the lateral sides are provided with workpiece slip preventive build-up welding parts extending from the side edges toward the central side of rotation or the central direction by one or two or more regeneration processes.

According to the regenerated cutting blade of the invention, a workpiece is inserted between this regenerated cutting blade and other opposite side cutting blade, and this workpiece can be sequentially sheared and ground. Of the lateral side of the regenerated cutting blade, the portion not forming the slip preventive build-up welding part is narrowed in the blade width due to wearing loss of the cutting blade, but the portion forming the slip preventive build-up welding part can be increased in the blade width by the build-up height portion of the slip preventive build-up welding part. As a result, when shearing and grinding the workpiece, the gap dimension between the slip preventive build-up welding part of the lateral sides of the regenerated cutting blade, and the lateral side of the opposite side cutting blade disposed opposite to this lateral side can be adjusted closely to the size of a new cutting blade.

Therefore, when shearing and grinding the workpiece, it is effective to prevent slipping of the workpiece, especially a long object, without being ground, through the gap between the lateral side of the regenerated cutting blade and the lateral side of the opposite side cutting blade.

Besides, the leading end edge and side edges of the regenerated cutting blade are regenerated and formed by build-up welding, and the grinding capability is enhanced closer to that of a new cutting blade.

In the regenerated cutting blade of the invention, the slip preventive build-up welding part is formed so as to pass through the lateral side of the blade tip.

The blade tip is the portion for shearing and grinding the workpiece. In the process of shearing and grinding, the workpiece is about to slip in and pass through the gap between the lateral side of the blade tip of the regenerated cutting blade and the lateral side of the opposite side cutting blade disposed oppositely to this lateral side, but the slip preventive build-up welding part formed so as to pass through the lateral side of the blade tip can effectively suppress the workpiece from getting in this gap and slipping out.

The regenerated cutting blade of the invention has a blade width of the regenerated cutting blade in the slip preventive build-up welding part nearly the same as the blade width of a new cutting blade.

In this manner, when shearing and grinding the workpiece, the possibility of the workpiece, especially, a long object, slipping out without being ground, from the gap between the lateral side of the regenerated cutting blade and the lateral side of the opposite side cutting blade can be suppressed as slow as when using a new cutting blade.

In the regenerated cutting blade of the invention, the lateral side of the regenerated cutting blade has a spacer abutting part abutting against a spacer for positioning the regenerated cutting blade in the axial direction of the center of its rotation, and the slip preventive build-up welding part is formed across a gap against the spacer abutting part.

In this manner, when the slip preventive build-up welding part is formed on a lateral side of a worn cutting blade, it is effective to prevent deformation of the spacer abutting part by this welding heat, or forming of a part of the build-up welding part on the surface of the spacer abutting part. As a result, when mounting the regenerated cutting blade on the shearing part grinder, the regenerated cutting blade can be smoothly mounted and fitted in the gap of a specified size formed between a spacer and other spacer. Moreover, the regenerated cutting blade can be positioned in the rotating direction of the center of its rotation accurately by the spacers.

The shearing type grinder of the invention, using the regenerated cutting blade of the invention, has a plurality of rotary blades detachably mounted on a tool rest. Two or more rotary blades each are provided on first and second rotational axes, and spacers are provided on the first and second rotational axes so as to enclose the rotary blades from both sides. The spacers are mounted on the first and second rotational axes, and the workpiece is sheared and ground between the first rotary blade mounted on the first rotational axis, and the second rotary blade mounted on the second rotational axis.

According to the shearing type grinder of the invention, by rotating the first and second rotational axes, the workpiece can be sheared and ground between the first rotary blade and the second rotary blade. The regenerated cutting blades used in this shearing type grinder act the same as the regenerated cutting blades of the invention.

In the shearing type grinder of the invention, when shearing and grinding the workpiece between the rotating first rotary blade and the second rotary blade, the individual slip preventive build-up welding parts are formed so that the slip preventive build-up welding part of the regenerated first cutting blade of the first rotary blade and the slip preventive build-up welding part of the regenerated second cutting blade of the second rotary blade may be opposite to each other.

In this configuration, at the time of shearing and grinding, the workpiece is inclined to get in and slip out of the gap between the lateral side of the regenerated first cutting blade and the lateral side of the regenerated second cutting blade disposed oppositely to this lateral side. However, the slip preventive build-up welding part of the regenerated first cutting blade, and the slip preventive build-up welding part of the regenerated second cutting blade are mutually opposite to each other, and so this gap can be narrowed by this pair of slip preventive build-up welding parts. It is thereby effective to suppress the workpiece from getting in and slipping out this gap.

Effects of the Invention

According to the regenerated cutting blade and the shearing type grinder of the invention, when shearing and grinding the workpiece, of the lateral sides of the regenerated cutting blades, out of the gap between the slip preventive build-up welding part, and the lateral side of the opposite side cutting blade, the workpiece can be suppressed from slipping and getting out without being ground. When the regenerated cutting blades are mounted and used in the shearing type grinder, or by using the shearing type grinder using the regenerated cutting blades, the grinding efficiency of the shearing type grinder can be improved closely to the grinding efficiency when new cutting blades are mounted on the shearing type grinder.

In addition, instead of the entire surface of the lateral sides of the worn cutting blades, by forming a slip preventive build-up welding part in part of the lateral side, cost, time, and labor for regenerating the worn cutting blades can be saved.

BRIEF DESCRIPTION OF THE DRAWINGS

FIG. 11 is a cross sectional view showing a conventional shearing type grinder.

FIG. 12 is a C-C cross-sectional view showing the shearing type grinder shown in FIG. 11.

FIG. 13 is a perspective view showing a new rotary blade.

FIG. 14 (*a*) is a perspective view showing a worn rotary blade, and FIG. 14 (*b*) is a sectional view showing a mutual gap of rotary blades of worn cutting blades shown in FIG. 14 (*a*).

DETAILED DESCRIPTION OF THE INVENTION

Figure 1:
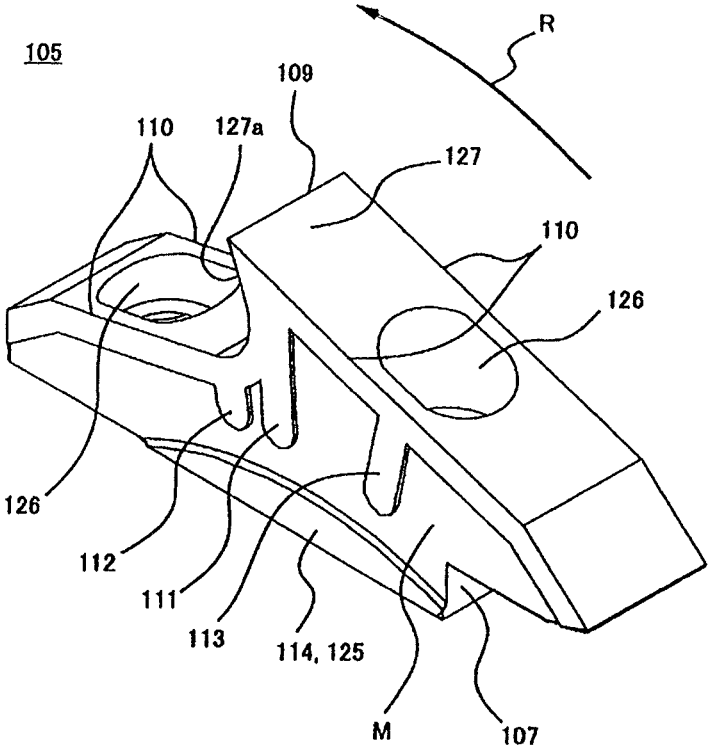
FIG. 1 is a perspective view showing a regenerated cutting blade in an embodiment of the invention.

An embodiment of regenerated cutting blades and a shearing type grinder having cutting blades according to the invention is described below with reference to FIG. 1 to FIG. 9. A rotary blade 103 having new cutting blades 105 shown in FIG. 13 is mounted on a shearing type grinder 100 shown in FIG. 11 and FIG. 12, and is used for a specific duration of time. A leading end edge 109 and side edges 110 are worn, and the grinding performance declines, and the grinding efficiency is lowered.

As a result, as shown in FIG. 14 (*a*), 14 (*b*), the leading end edge 109 and the side edges 110 are worn and formed in a round state, and defects may be caused in the leading end edge 109 and the side edges 110.

In this manner, in particular, the side edges 110 are worn out, and the dimension of the blade width W1 of the cutting blade 105 is reduced. Consequently, a gap S1 more than specified may be formed between mutually opposing lateral dies of the worn cutting blades 105 mounted on the shearing type grinder 100, and thereby the grinding efficiency may be lowered.

Accordingly, by using the regenerating method of a regenerated blade and its regenerating equipment (not shown), the leading end edge 109 and the side edges 110 of the worn cutting blade 105 are repaired (regenerated). Therefore, the worn cutting blade 105 can be regenerated, and used again. The cutting blade 105 regenerated in this manner is the regenerated cutting blade 105 (see FIG. 1) of the invention.

Moreover, a new cutting blade 105 of the rotary blade 103 shown in FIG. 13 includes a leading end edge 109 pointed to the rotating direction R side of the blade tip 127 projecting outward in the radial direction, and side edges 110 formed along the lateral side outer periphery. On the mounting face (lower side of a fixed part 125) of the cutting blade 105, an engagement step 107 is provided, and this engagement step 107 is engaged with an engagement protrusion 108 provided in the tool rest 106 so as to receive the grinding reaction.

The leading edge 109 and side edges 110 are worn by shearing and grinding as shown in FIG. 14 (*a*), (*b*), but the cutting blade 105 having the leading edge 109 and side edges 110 is of split type. Therefore, if the leading edge 109 and side edges 110 are worn, only the cutting blade 105 can be replaced without exchanging the tool rest 106.

Besides, reference numeral 126 shown in FIG. 13 is a bolt insertion hole. This bolt insertion hole 126 is for inserting a fixing bolt for mounting the cutting blade 105 detachably on the tool rest 106.

The regenerated cutting blade 105 of the invention shown in FIG. 1 is more specifically described. The regenerated cutting blade 105 is obtained by regenerating the worn cutting blade 105 of the rotary blade 103 shown in FIG. 14.

Figure 2A:
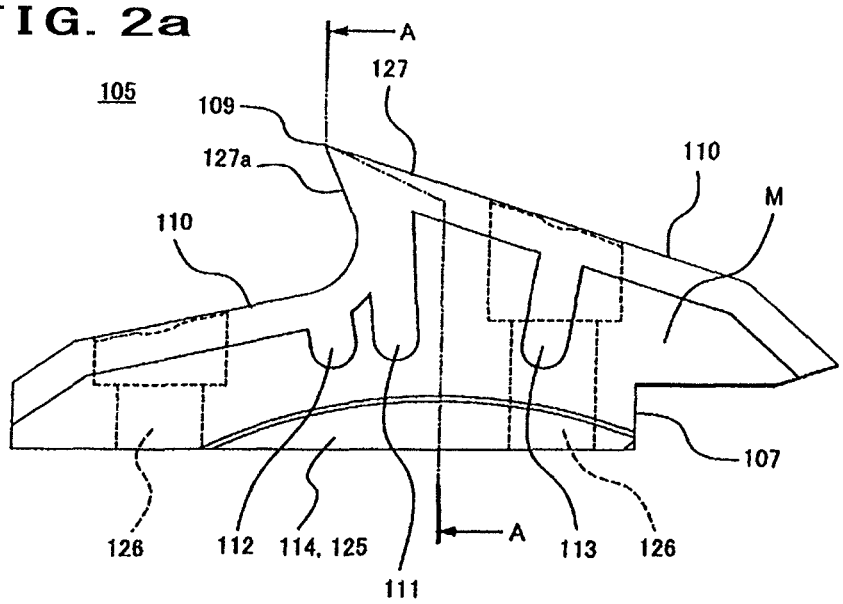
FIG. 2 (*a*) is a side view showing the regenerated cutting blade in FIG. 1, and FIG. 2 (*b*) is a side view from direction A-A showing the gap between rotary blades having the regenerated cutting blades shown in FIG. 1.
Figure 2B:
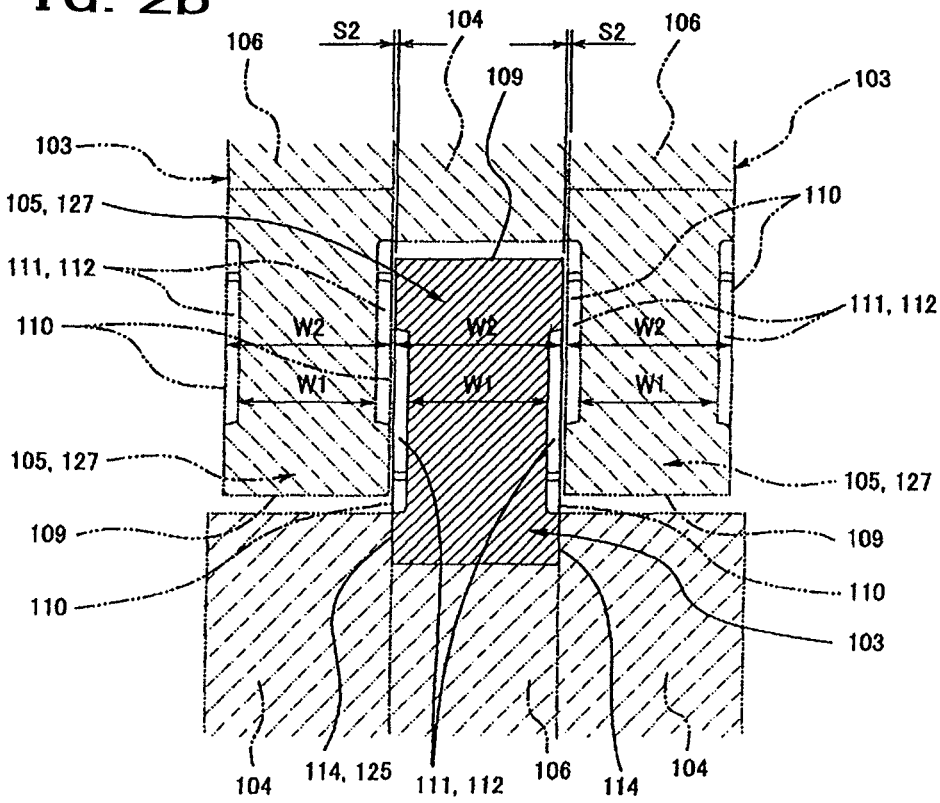

As shown in FIG. 1 and FIG. 2, the regenerated cutting blade 105 has its leading edge 109 and side edges 110 regenerated (formed) by build-up welding.

Figure 6:
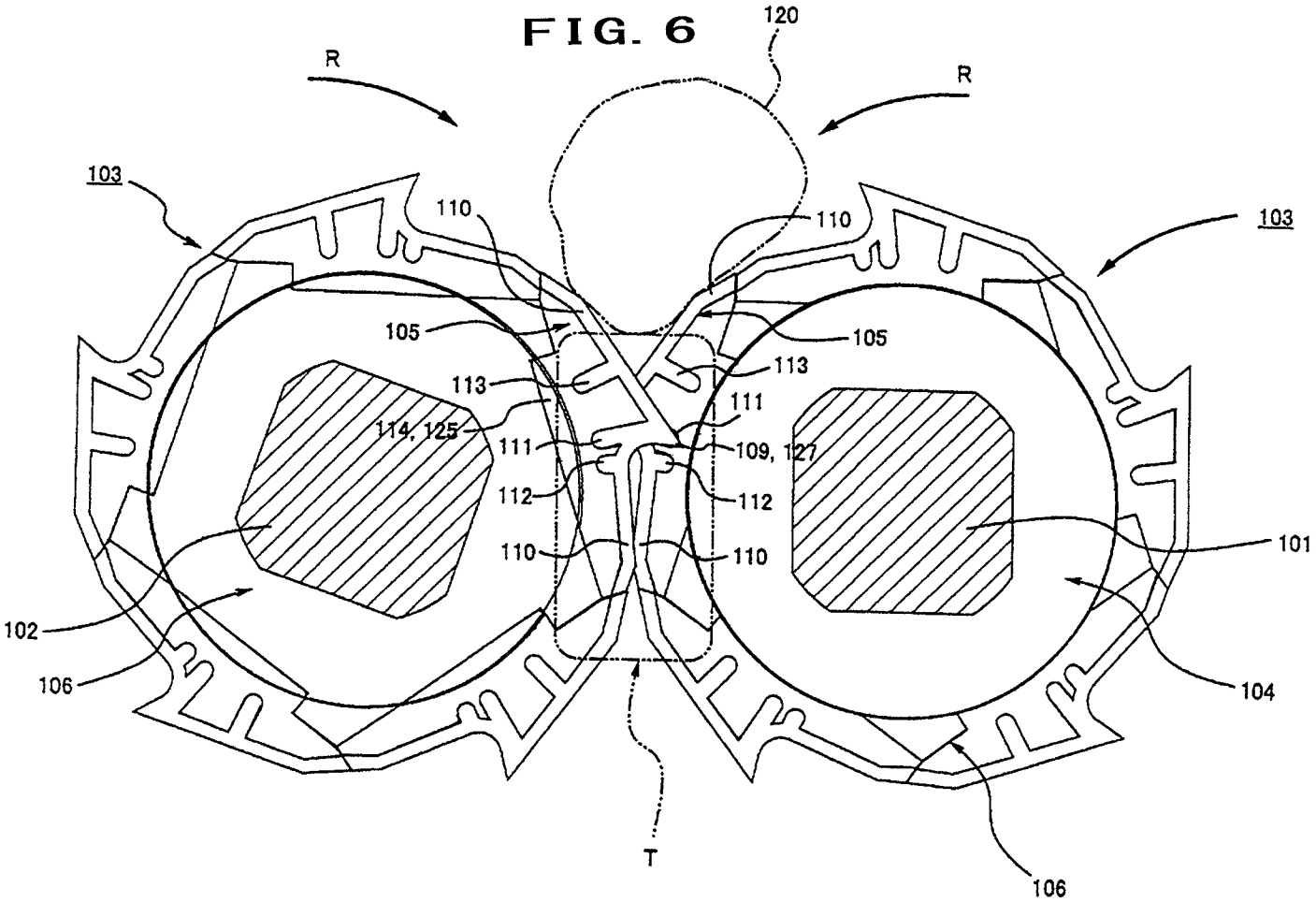
FIG. 6 is a side view showing an overlapped state of engagement of two rotary blades shown in FIG. 3.

On the lateral sides of the regenerated cutting blade 105, slip preventive build-up welding parts 111, 112, 113 of the workpiece 120 extending from the side edges 110 toward the central direction of rotation (or to the central side of rotation, and toward the spacer abutting part 114 and fixed part 125, as shown in FIG. 1) are formed by regenerating process of one, two, or more, for example, three build-up welding steps. The central direction of rotation is, as shown in FIG. 6, the central direction of rotation of the rotary blade 103 having the regenerated cutting blades 105.

Further, as shown in FIG. 1 and FIG. 2, the slip preventive build-up welding parts 111 to 113 are formed on the lateral sides of the cutting blade 105 in a band form by a specified length and width. In this embodiment, the first slip preventive build-up welding part 111 is formed at a position passing the side of the blade tip 127, and passing near the leading edge 109. The second slip preventive build-up welding part 112 is formed at a position at the opposite side of the first slip preventive build-up welding part 111, on the basis of a face 127*a* of the blade tip 127. The third second slip preventive build-up welding part 113 is formed at a position departing from the first slip preventive build-up welding part 111 toward the anti-rotation direction from the face 127*a*, on the basis of the face 127*a* of the blade tip 127.

Moreover, as shown in FIG. 2 (*b*), the blade width W2 of the regenerated cutting blade 105 in the first to third slip preventive build-up welding parts 111 to 113 is formed to be nearly the same as the blade width W2 of a new cutting blade 105. Similarly, the blade width W2 of the regenerated cutting blade 105 in the side edges 110 is formed to be nearly the same as the blade width W2 of a new cutting blade 105.

As shown in FIG. 2 (*a*), FIG. 2 (*b*), the lateral side of the regenerated cutting blade 105 has a spacer abutting part 114 abutting against the spacer 104 for positioning the regenerated cutting blade 105 in the axial direction of its rotation center (axial direction of the rotational axes 101, 102). The first to third slip preventive build-up welding parts 111 to 113 are formed across a gap from the spacer abutting part 114.

The surface of the spacer abutting part 114 contacts the spacer 104, and is a portion not contacting the workpiece 120, and therefore the blade width W2 is the same as the blade width W2 of a new cutting blade 105 (i.e., the surface of the spacer abutting part 114 is not ground down).

Figure 3:
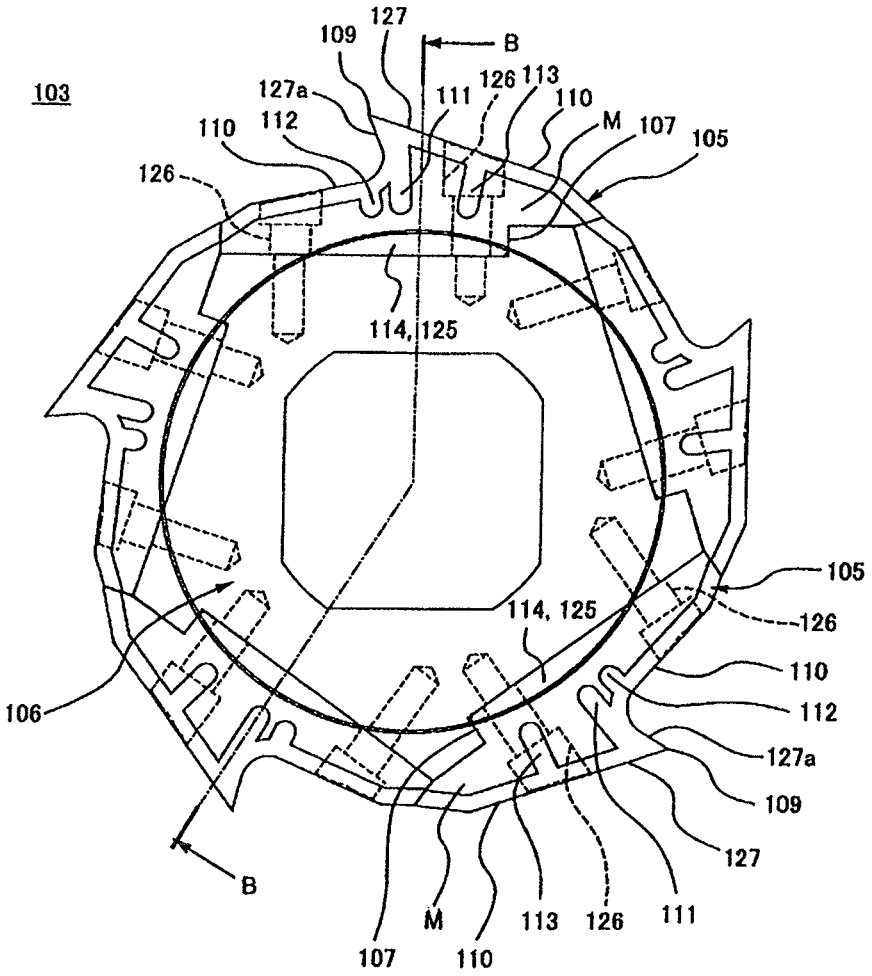
FIG. 3 is a side view of the rotary blade having the regenerated cutting blade shown in FIG. 1.
Figure 4A:
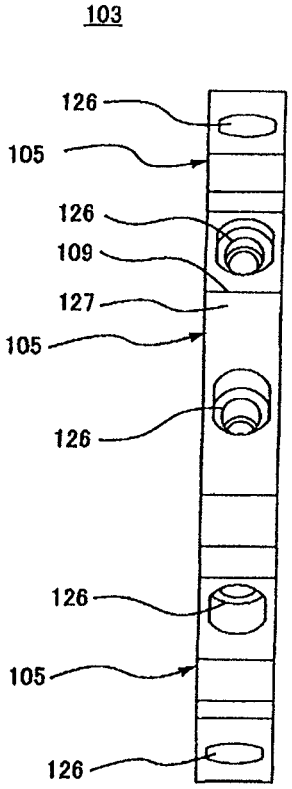
FIG. 4 (*a*) is a front view of the rotary blade shown in FIG. 3, and FIG. 4 (*b*) is a B-B sectional view of the rotary blade shown in FIG. 3.
Figure 4B:
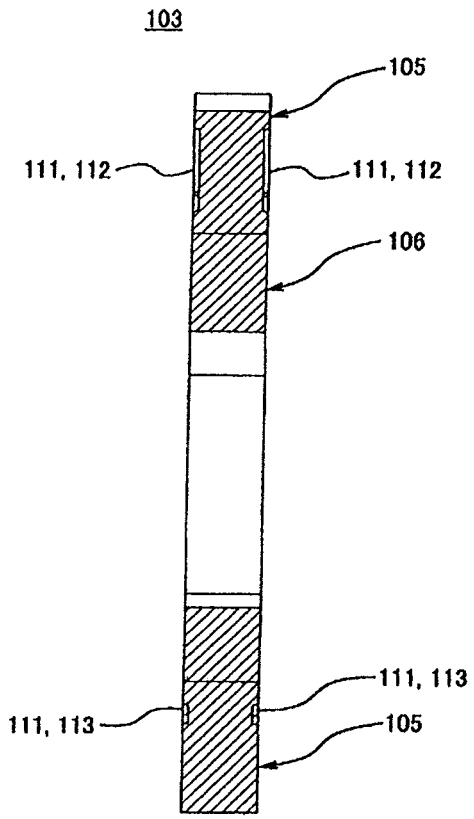
Figure 5:
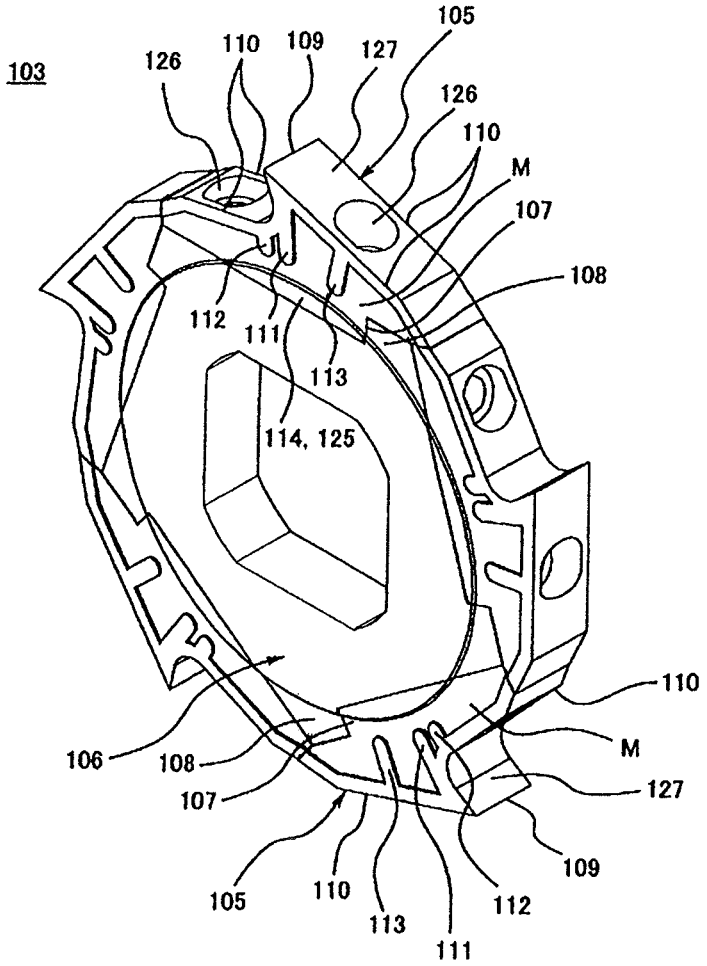
FIG. 5 is a perspective view of the rotary blade shown in FIG. 3.

The regenerated cutting blade 105 having such configuration is, as shown in FIG. 3 to FIG. 5, mounted on the tool rest 106 detachably by five bolts, and the rotary blade 103 can be manufactured in this manner. This rotary blade 103 is mounted by two pieces or more each on the first and second rotational axes 101, 102, as in the prior art as shown in FIG. 11. As shown in FIG. 2 (*b*), spacers 104 enclose each spacer abutting part 114 from both sides at both sides of the regenerated cutting blades 105, so as to be mounted and used in the shearing type grinder 100.

According to this shearing type grinder 100, as shown in a lateral view in FIG. 6, the workpiece 120 is inserted, sheared and ground between (i) the plurality of first rotary blades 103 provided on the first rotational axis 101 and (ii) the plurality of second rotary blades 103 provided on the second rotational axis 102.

As shown in FIG. 6, moreover, when attempting to shear and grind the workpiece 110 between the first rotary blade 103 and the second rotary blade 103, that is, when rotating in a range T in an overlapped state with the cutting blade 105 of the first rotary blade 103 and the cutting blade 105 of the second rotary blade 103 being engaged with each other, the individual slip preventive build-up welding parts 111 to 113 are formed so that the slip preventive build-up welding parts 111 to 113 of the regenerated first cutting blade 105 of the first rotary blade 103, and the slip preventive build-up welding parts 111 to 113 of the regenerated second cutting blade 105 of the second rotary blade 103 may be opposite to each other, or may be nearly at the same rotating positions.

Next is described the action of the thus composed regenerated cutting blades 105, and the shearing type grinder 100 on which they are mounted. According to the shearing type grinder 100 having the regenerated cutting blades 105, as shown in FIG. 6, the workpiece 120 can be placed between the cutting blades 105 mounted on the first rotational axis 101, and the opposite side regenerated cutting blades 105 mounted on the second rotational axis, and the workpiece 120 can be sequentially sheared and ground.

Consequently, as shown in FIG. 2 (*b*), of the lateral sides of the regenerated cutting blade 105, the portion not forming the slip preventive build-up welding parts 111 to 113, is narrower in the blade width W1 due to wearing loss of the cutting blade 105. However, the portion forming the slip preventive build-up welding parts 111 to 113 is W2 in the blade width, is larger by the portion of the build-up height of the slip preventive build-up welding parts 111 to 113. Hence, when shearing and grinding the workpiece 120, the dimension of the gap S2 between the slip preventive build-up welding parts 111 to 113, out of the lateral sides of the regenerated cutting blades 105, and the slip preventive build-up welding parts 111 to 113, out of the lateral sides of the opposite side regenerated cutting blades 105 disposed oppositely thereto, can be controlled to be closer to that of a new cutting blade 105.

Therefore, when shearing and grinding the workpiece 120, the workpiece 120 is suppressed from slipping out without being ground in the gap S2 between the lateral side of the regenerated cutting blade 105, and the lateral side of the opposite side regenerated cutting blade 105, especially in the case of a long object.

In this way, it is possible to suppress the possibility of slipping of the workpiece 120, especially a long object, without being ground. It also means that the workpiece 120, especially a long object, is prevented from slipping out of the gap S2, by the slip preventive build-up welding parts 111 to 113, and the workpiece 120 can be cut to a relatively short length of less than the pitch of the five regenerated cutting blades 105 mounted on the rotary blade 103 shown in FIG. 3.

Still more, the leading end edge 109 and the side edges 110 of the regenerated cutting blade 105 are regenerated by build-up welding, and the grinding capability can be improved closer to that of a new cutting blade 105. Hence, when the regenerated cutting blades 105 are mounted and used in the shearing type grinder 100, the grinding efficiency of the shearing type grinder 100 can be improved closer to the grinding efficiency when new cutting blades 105 are mounted on the shearing type grinder 100.

Further, as shown in FIG. 1, the slip preventive build-up welding parts 111 to 113 may be formed in part of the lateral sides, instead of the entire lateral sides of the work cutting blade 105. Therefore, the cost, time, and labor regenerating the work cutting blade 105 can be saved.

The blade tip 127 of the cutting blade 105 shown in FIG. 2 (*a*) is a portion for shearing and grinding the workpiece 120. At the time of shearing and grinding, the workpiece 120 tends to enter and slip through the gap S2 between the lateral side of the blade tip 127 of the regenerated cutting blade 105, and the lateral side of the opposite side regenerated cutting blade 105 disposed at an opposite side of this lateral side. Due to the slip preventive build-up welding parts 111 to 113 formed so as to pass the side or vicinity of the blade tip 127, however, the workpiece 120 is effectively suppressed from slipping through this gap S2.

As shown in FIG. 2 (*b*), the blade width W2 of the regenerated cutting blade 105 in the slip preventive build-up welding parts 111 to 113 is formed nearly the same as the blade width W2 of a new cutting blade 105. Therefore, when shearing and grinding the workpiece 120, the possibility of the workpiece 120, especially a long object, slipping out without being ground in the gap S2 between the lateral side of the regenerated cutting blade 105, and the lateral side of the opposite side regenerated cutting blade 105 can be suppressed as low as in the case of using a new cutting blade 105.

Thus, the reasons of suppressing the possibility of slipping of the workpiece 120, especially a long object, without being ground are same as mentioned above.

Still more, as shown in FIG. 1, since the slip preventive build-up welding parts 111 to 113 are formed across intervals from the spacer abutting part 114, when the slip preventive build-up welding parts 111 to 113 are formed on the lateral side of the worn cutting blade 105 by welding, it is effective to prevent deformation of the spacer abutting part 114 due to the welding heat, or formation of part of the build-up welding parts 111 to 113 on the surface of the spacer abutting part 114. As a result, when the regenerated cutting blade 105 is mounted on the tool rest 106 of the shearing type grinder 100, the regenerated cutting blade 105 can be smoothly inserted in a specified gap formed between the spacer 104 and the spacer 104. And the regenerated cutting blade 105 can be positioned in the axial direction of the center of its rotation (the axial direction of rotational axes 101, 102) accurately by the spacers 104.

Further, as shown in FIG. 6, when the regenerated first cutting blade 105 of the first rotary blade 103, and the regenerated second cutting blade 105 of the second rotary blade 103 rotate in a range T in an overlapped state being engaged with each other, the individual slip preventive build-up welding parts 111 to 113 are formed so that the slip preventive build-up welding parts 111 to 113 of the regenerated first cutting blade 105 of the first rotary blade 103, and the slip preventive build-up welding parts 111 to 113 of the regenerated second cutting blade 105 of the second rotary blade 103 may be opposite to each other, or may be nearly at the same rotating positions.

In this configuration, at the time of shearing and grinding, the workpiece 120 is inclined to get in and slip through the gap S2 between the lateral side of the regenerated first cutting blade 105 of the first rotary blade 103, and the lateral side of the regenerated second cutting blade 105 of the second rotary blade 103 disposed oppositely to this lateral side. However, the slip preventive build-up welding parts 111 to 113 of the regenerated first cutting blade 105, and the slip preventive build-up welding parts 111 to 113 of the regenerated second cutting blade 105 are mutually opposite to each other, and so the gap S2 may be narrowed by the corresponding pair of slip preventive build-up welding parts 111 to 113. As a result, it is effectively possible to suppress the workpiece 120 from getting in and slipping through the gap S2.

Figure 7A:
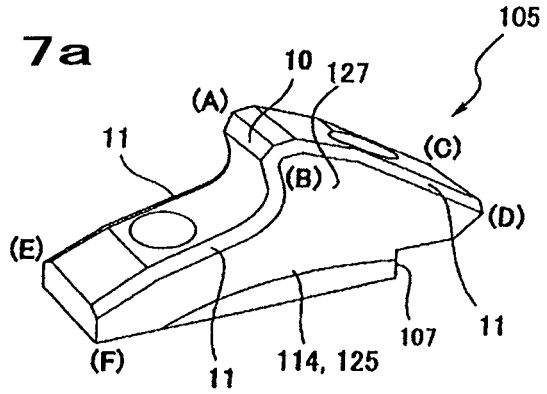
FIG. 7 (*a*) to FIG. 7 (*c*) are perspective views showing a manufacturing method of the regenerated cutting blade shown in FIG. 1.
Figure 7B:
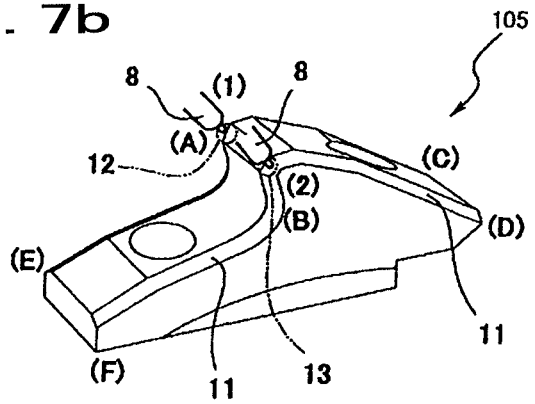
Figure 7C:
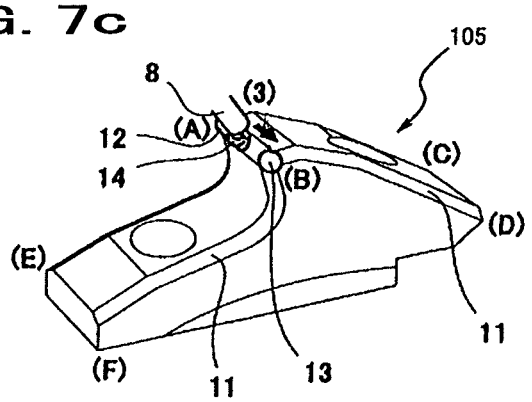

Next is explained the regenerating method of the cutting blades according to the embodiment. The regenerating method of cutting blades includes a chamfering step of chamfering the leading end edge 109 and the side edges 10 of the worn cutting blade 105 shown in FIGS. 14 (*a*), 14 (*b*), as shown in FIG. 7 (*a*), a build-up welding step of building up and welding the lateral sides of the leading edge 109 and side edge 110 after being chamfered as shown in FIG. 7 (*b*), (*c*), FIG. 8, FIG. 9, and a processing step of regenerating the build-up welding parts of the cutting blade 105 in a specified shape as shown in FIG. 1. In this manner, the worn cutting blade 105 can be regenerated, and the regenerated cutting blade 105 (see FIG. 1) can be manufactured.

Figure 8A:
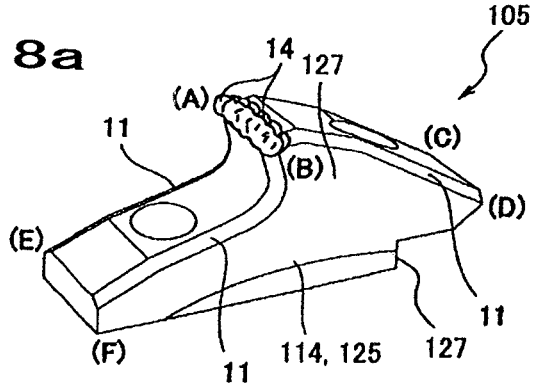
FIG. 8 (*a*) to FIG. 8 (*c*) are perspective views showing a manufacturing method of the regenerated cutting blade following FIG. 7.
Figure 8B:
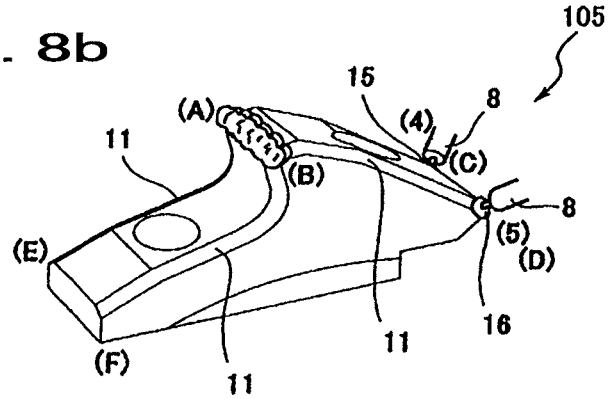
Figure 8C:
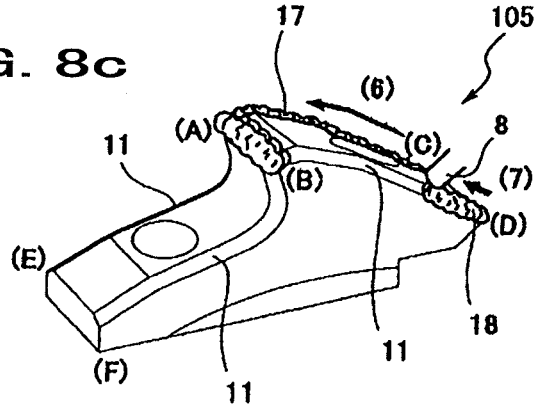
Figure 9A:
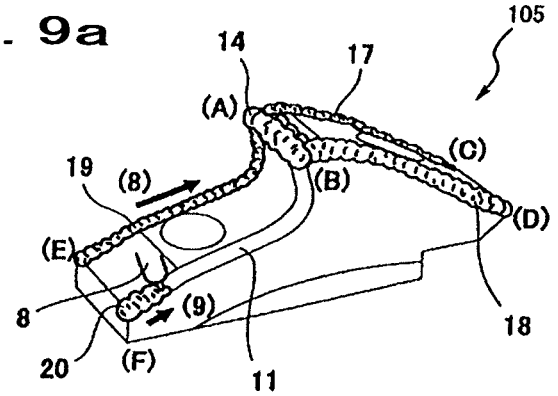
FIG. 9 (*a*) to FIG. 9 (*c*) are perspective views showing a manufacturing method of the regenerated cutting blade following FIG. 8 (*a*) to FIG. 8(*c*).
Figure 9B:
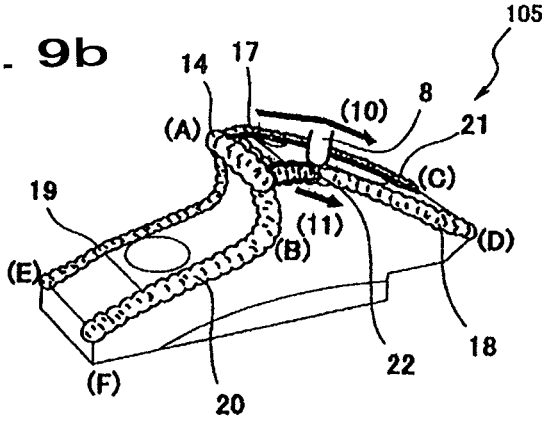
Figure 9C:
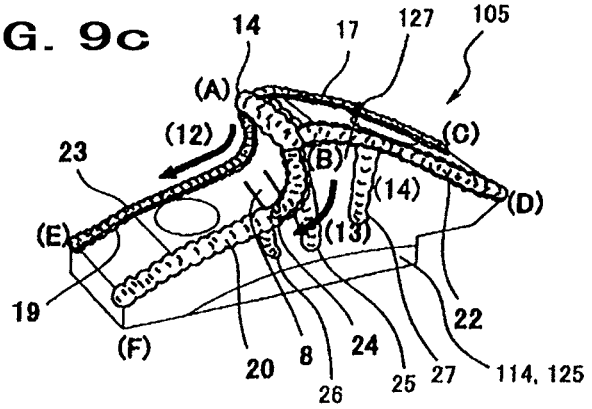

FIG. 7 (*a*) to FIG. 7 (*c*) are perspective views showing the manufacturing method of the regenerated cutting blade 105 shown in FIG. 1, FIG. 8 (*a*) to FIG. 8 (*c*) are perspective views showing the manufacturing method of the regenerated cutting blade 105 succeeding FIG. 7, and FIG. 9 (*a*) to FIG. 9 (*c*) are perspective views showing the manufacturing method of the regenerated cutting blade 105 succeeding FIG. 8. By reference to these drawings, the manufacturing method of the regenerated cutting blade 105 is explained. Throughout the drawings, for the sake of ease of explanation, the corner positions of the cutting blade 105 are identified with symbols (A) to (F), and the procedure is explained in the numerical sequence of (1) to (13).

First of all, as shown in FIG. 7 (*a*), the leading end edge 109 and the side edges 110 of the cutting blade 105 are chamfered as specified (10, 11).

Next, as shown in FIG. 7 (*b*), reinforcing build-up welding materials are arc-spot welded sequentially (12, 13) by using a welding nozzle 8, at positions thickness direction both end positions (A), (B) of the leading end edge 109 [(1), (2)].

As shown in FIG. 7 (*c*), consequently, reinforcing build-up welding materials are built up and welded (14) between arc-spot welding parts 12, 13 of the leading end edge 109 [(3)]. This build-up welding 14 is performed from position (A) toward position (B) of the previous arc-spot welding 12, and is intended to prevent effective welding droop by the arc-spot welding 12, 13.

In addition, the leading edge 4 is heavily worn, as shown in FIG. 8 (*a*). By build-up welding 14 of at least two layers, the portion of high hardness is increased. Such build-up welding is preferable because the impact resistance and wear resistance of the leading end edge 109 can be enhanced.

Then, as shown in FIG. 8 (*b*), arc-spot welding 15, 16 is performed sequentially by reinforcing build-up welding materials at positions (C), (D) at both ends in the thickness direction of the acute angle portion in the anti-rotation direction end part of the side edges 110 [(4), (5)].

As shown in FIG. 8 (*c*), consequently, build-up welding 17, 18 is performed from the position of end parts (C), (D) of the arc-spot welding 15, 16 toward the position of (A), (B) of the leading end edge 109 [(6), (7)]. This build-up welding 17, 18 is also performed from position (C) of the previous arc-spot welding 15 toward position (A) of the leading end edge 109, and is intended to prevent effective welding droop by the arc-spot welding 15, 16.

Next, as shown in FIG. 9 (*a*), build-up welding 19, 20 is performed from the position of other peripheral direction end parts (E), (F) of the side edges 110 toward the position of (A), (B) of the leading end edge 109 [(8), (9)]. Since the position of peripheral direction end parts (E), (F) is not an acute angle, and without performing the arc-spot welding 15, 16 as mentioned above, build-up welding 19, 20 is performed.

Also as shown in FIG. 9 (*b*), in this example, the build-up welding of the side edges 110 is performed in the reverse direction of the build-up welding 17, 18 of the side edges 110 mentioned above, from the position of (A), (B) of the leading end edge 4 toward the position of (C), (D) of peripheral direction end parts as build-up welding 21, 22 [(10), (11)]. As shown in FIG. 9 (*c*), build-up welding 23, 24 is performed from the position of (A), (B) of the leading end edge 109 toward the position of peripheral direction end parts (E), (F) [(12), (13)], thereby eliminating the welding distortion caused by the previous build-up welding 17 to 20.

Further, as shown in FIG. 9 (*c*), on the lateral sides of the both cutting blade 105, build-up welding 25, 26, 27 is performed by using reinforcing build-up welding materials, in the portion of forming the first to third slip preventive build-up welding parts 111, 112, 113 [(14)].

Afterwards, after completion of build-up welding parts 14, 17, 22, 23, 24, 25, 26, 27 shown in FIG. 9 (*c*), by grinding and processing by a machine tool not shown, as shown in FIG. 1, cutting blades 105 are formed by forming the leading end edge 109, side edges 110, and slip preventive build-up welding parts 111, 112, 113.

Figure 10:
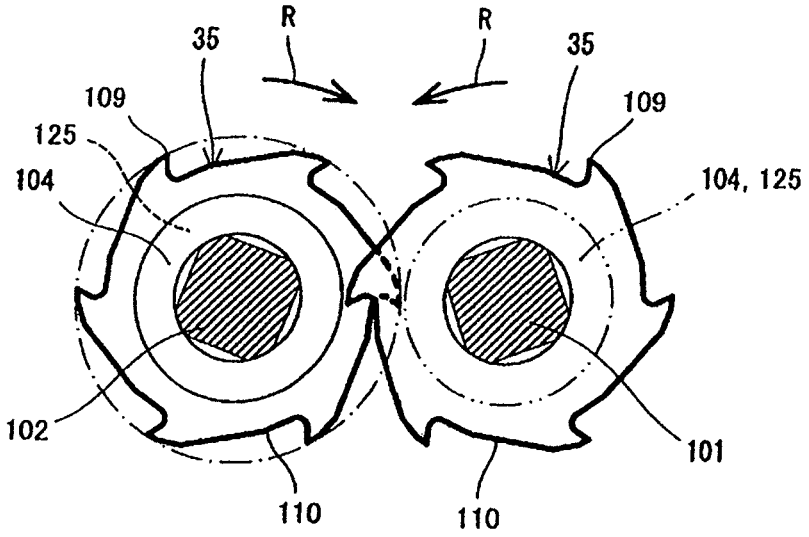
FIG. 10 is a side view showing an overlapped state of engagement of cutting blades in other embodiment of the invention.
Figure 10:
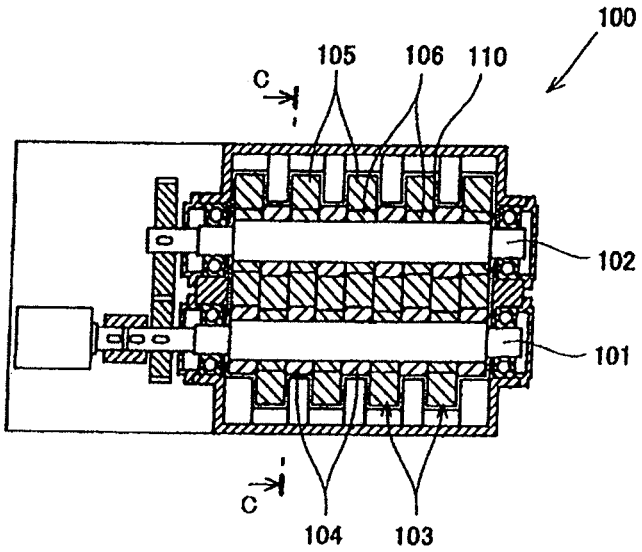

In this embodiment, however, the invention is explained by referring to an example of the split type cutting blade 105 as shown in FIG. 6. Instead, as shown in FIG. 10, it may be applied in an integral type cutting blade 35. The fixed part 125 of this integral type cutting blade 35 is fixed and mounted on rotational axis 101 or 102.

The slip preventive build-up welding parts of the embodiment are formed on the lateral sides of the cutting blade 105 in the position, size, range, and number as shown in FIG. 1, but may be formed on the lateral sides of the cutting blade 105 in other position, size, range, and number.

In the embodiment, as shown in FIG. 1, the first to third slip preventive build-up welding parts 111 to 113 are formed across an interval from the spacer abutting part 114. Instead, any one or all of the first to third slip preventive build-up welding parts 111 to 113 may be formed to be bonded with the spacer abutting part 114.

INDUSTRIAL APPLICABILITY

As described herein, the regenerated cutting blade and the shearing type grinder of the invention are capable of regenerating efficiently by saving the cost and labor for regenerating the cutting blades. When mounted and used in the shearing type grinder, the grinding efficiency of the shearing type grinder can be improved closely to that of a new cutting blade, and it is suitable to be applied in such regenerated cutting blades and the shearing type grinder.

DESCRIPTION OF THE REFERENCE NUMERALS

10, 11 chamfering
12, 13 arc-spot welding
14 build-up welding
15, 16 arc-spot welding
17-24 build-up welding
25, 26, 27 slip preventive build-up welding
35 integral type cutting blade
100 shearing type grinder
101, 102 rotational axis
103 rotary blade
104 spacer
105 cutting blade
106 tool rest
107 engagement step
108 engagement protrusion
109 leading end edge
110 side edge
111 first slip preventive build-up welding part
112 second slip preventive build-up welding part

113 third slip preventive build-up welding part
114 spacer abutting part
120 workpiece
125 fixed part
126 bolt insertion hole
127 blade tip
127*a* face
M worn portion
R rotating direction
S1, S2 gap
T range of overlapped state
W1, W2 blade width

What is claimed is:

1. A regenerated cutting blade comprising:

a fixed part having a pair of spacer abutting parts each located on a respective one of opposite lateral sides of the fixed part, each of the spacer abutting parts being configured to abut against a respective adjacent spacer; and a blade tip projecting from the fixed part outward in a radial direction;

wherein the blade tip includes:

a leading edge extending in a direction of rotation;

side edges formed on lateral side outer edges of the blade tip, the leading edge and the side edges being regenerated built-up-weld edges; and a plurality of elongated regenerated slip preventive built-up-weld parts on each of lateral sides of the blade tip and extending inward in a radial direction from a respective one of the side edges toward a respective one of the pair of spacer abutting parts, a gap being formed between the regenerated slip preventive built-up-weld parts on each of the lateral sides of the blade tip and a respective one of the spacer abutting parts.

2. The regenerated cutting blade according to claim 1, wherein the regenerated slip preventive built-up-weld parts pass lateral sides of the blade tip.

3. The regenerated cutting blade according to claim 1, wherein a blade width of the blade tip at the regenerated slip preventive built-up-weld parts is the same as a blade width of the fixed part at the spacer abutting parts.

4. A shearing grinder comprising:

a plurality of rotary blades, each of the rotary blades including a tool rest and a plurality of cutting blades detachably mounted on the tool rest, and at least two of the rotary blades being mounted on separate first and second rotational axes;

spacers mounted on each of the first and second rotational axes so as to enclose each of the rotary blades from both axial sides of each of the rotary blades;

wherein the rotary blades and the spacers are configured such that a workpiece is sheared and ground between a first rotary blade mounted on the first rotational axis and a second rotary blade mounted on the second rotational axis; and wherein each of the cutting blades of each of the rotary blades comprises:

a fixed part having a pair of spacer abutting parts each located on a respective one of opposite lateral sides of the fixed part, each of the spacer abutting parts abutting against a respective adjacent one of the spacers; and a blade tip projecting from the fixed part outward in a radial direction;

wherein the blade tip includes:

a leading edge extending in a direction of rotation;

side edges formed on lateral side outer edges of the blade tip, the leading edge and the side edges being regenerated built-up-weld edges; and a plurality of elongated regenerated slip preventive built-up-weld parts on each of lateral sides of the blade tip and extending inward in a radial direction from a respective one of the side edges toward a respective one of the pair of spacer abutting parts, a gap being formed between the elongated regenerated slip preventive built-up-weld parts on each of the lateral sides of the blade tip and a respective one of the spacer abutting parts.

5. The shearing grinder according to claim 4, wherein the elongated regenerated slip preventive built-up-weld parts are formed so that, when shearing and grinding the workpiece between the first rotary blade and the second rotary blade, the elongated regenerated slip preventive built-up-weld parts of a lateral side of the first rotary blade and elongated regenerated slip preventive built-up-weld parts of a lateral side of the second rotary blade are opposite to each other.

* * * * *